US011720129B2

(12) United States Patent
Lin

(10) Patent No.: US 11,720,129 B2
(45) Date of Patent: Aug. 8, 2023

(54) VOLTAGE REGULATION SYSTEM RESISTANT TO LOAD CHANGES AND METHOD THEREOF

(71) Applicant: Realtek Semiconductor Corp., Hsinchu (TW)

(72) Inventor: Chia-Liang (Leon) Lin, Fremont, CA (US)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 263 days.

(21) Appl. No.: 16/858,830

(22) Filed: Apr. 27, 2020

(65) Prior Publication Data

US 2021/0333813 A1 Oct. 28, 2021

(51) Int. Cl.
*G05F 1/575* (2006.01)
*G05F 3/24* (2006.01)

(52) U.S. Cl.
CPC ..... *G05F 1/575* (2013.01); *G05F 3/24* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS 6,414,537 B1 * 7/2002 Smith ..... G05F 1/468 327/540
6,465,994 B1 * 10/2002 Xi ..... G05F 1/575 323/280
7,106,033 B1 * 9/2006 Liu ..... G05F 1/575 323/280
9,874,889 B1 * 1/2018 Zhao ..... G05F 1/575
10,222,818 B1 * 3/2019 Lin ..... G05F 1/468
2014/0015509 A1 * 1/2014 Gupta ..... G05F 3/30 323/313

(Continued)

FOREIGN PATENT DOCUMENTS

CN 104734634 A 6/2015
CN 110737298 A 1/2020

OTHER PUBLICATIONS

Chinese language office action dated Jun. 6, 2022, issued in application No. CN 202011162340.6.

*Primary Examiner* — Thienvu V Tran
*Assistant Examiner* — Nusrat Quddus
(74) *Attorney, Agent, or Firm* — McClure, Qualey & Rodack, LLP

(57) ABSTRACT

A voltage regulation system includes a voltage regulator configured to receive a first reference voltage and output a regulated voltage; a bias voltage generator comprising a diode-connect transistor configured to receive a bias current and output a reference gate voltage; and a plurality of switch-load circuits, each of said plurality of switch-load circuits comprising a common-drain transistor configured to receive power from the regulated voltage and control from the reference gate voltage via a switch controlled by a logical signal and output a supply voltage to load with a decoupling capacitor, wherein a size of the common-drain transistor is scaled from a size of the diode-connect transistor in accordance with a ratio between a current of the load and the bias current.

13 Claims, 2 Drawing Sheets

(56) References Cited

U.S. PATENT DOCUMENTS

| | | | | |
|---|---|---|---|---|
| 2015/0180412 | A1* | 6/2015 | Lin | H03B 5/1212<br>331/117 FE |
| 2015/0234404 | A1* | 8/2015 | Agarwal | G05F 1/575<br>323/273 |
| 2017/0017249 | A1* | 1/2017 | Jezik | G05F 1/468 |
| 2017/0160757 | A1* | 6/2017 | Yang | G05F 1/575 |
| 2019/0011944 | A1* | 1/2019 | Ono | G05F 1/565 |

* cited by examiner

VOLTAGE REGULATION SYSTEM RESISTANT TO LOAD CHANGES AND METHOD THEREOF

BACKGROUND OF THE DISCLOSURE

Field of the Disclosure

The present disclosure generally relates to voltage regulation, and more particularly to a voltage regulation system and method that minimizes voltage spikes in response to sudden load changes.

Description of Related Art

As shown in FIG. 1, a prior art voltage regulation system 100 comprises: a current-to-voltage converter 110 configured to receive a reference current $I_{REF}$ and output a reference voltage $V_{REF}$; a voltage regulator 120 configured to receive the reference voltage $V_{REF}$ and output a regulated voltage $V_{REG}$; and a plurality of loads and switches including a first load 131 configured to receive the regulated voltage $V_{REG}$ via a first switch 132 controlled by a first control signal EN1, a second load 141 configured to receive the regulated voltage $V_{REG}$ via a second switch 142 controlled by a second control signal EN2, and so on. Throughout this disclosure, "$V_{DD}$" denotes a power supply node. The current-to-voltage converter 110 comprises resistors 111 and 112, and capacitor 113, wherein resistor 111 functions as a load to provide a current-to-voltage conversion, while resistor 112 and capacitor 113 form a low-pass filter. The voltage regulator 120 comprises: an operational amplifier 122 and a NMOS (n-channel metal oxide semiconductor) transistor 123 configured to form a control loop with a negative feedback to make the regulated voltage $V_{REG}$ track the reference voltage $V_{REF}$. The current-to-voltage converter 110 and the voltage regulator 120 are both well known in the prior art and thus not explained in detail here. When the first (second) control signal EN1 (EN2) is asserted, the first (second) switch 132 (142) is turned on to cause the first (second) load 131 (141) to be powered up by the regulated voltage $V_{REG}$. When the first (second) control signal EN1 (EN2) is de-asserted, the first (second) switch 132 (142) is turned off to cause the first (second) load 131 (141) to be powered down. This way, the first load 131, the second load 141, and so on can be independently powered up or powered down.

A sudden change in one of the loads among the first load 131, the second load 132, and so on may cause a spike in the regulated voltage $V_{REG}$, since a speed of the control loop of the voltage regulator 120 is limited and it cannot act fast enough to make adjustment to handle the sudden change. To alleviate the spike in the regulated voltage $V_{REG}$, a decoupling capacitor 151 is added to help to hold $V_{REG}$ steadier during the sudden change. The addition of the decoupling capacitor 151, however, degrades a stability of the control loop of the voltage regulator 120. It is imperative that the voltage regulator 120 is stable regardless of a change of the loading condition, and a spike in the regulated voltage $V_{REG}$ is small under a sudden change of load condition. This usually posts a strict constraint on the design of the voltage regulator 120, and a performance of how effectively the regulated voltage $V_{REG}$ can be regulated is usually compromised.

What is desired is a voltage regulation system effectively alleviates voltage spikes that result from sudden load changes.

BRIEF DESCRIPTION OF THIS DISCLOSURE

In an embodiment, a system comprises: a voltage regulator configured to receive a first reference voltage and output a regulated voltage; a bias voltage generator comprising a diode-connect transistor configured to receive a bias current and output a reference gate voltage; and a plurality of switch-load circuits, each of said plurality of switch-load circuits comprising a common-drain transistor configured to receive power from the regulated voltage, receive control from the reference gate voltage via a switch controlled by a logical signal, and output a supply voltage to a load shunt with a decoupling capacitor, wherein a size of the common-drain transistor is scaled from a size of the diode-connect transistor in accordance with a ratio between a current of the load and the bias current.

In an embodiment, a system comprises: a voltage regulator configured to receive a first reference voltage and output a regulated voltage; a bias voltage generator configured to receive a bias current and output a reference gate voltage, the bias voltage generator comprising a series connection of a resistor and a diode-connect NMOS (n-channel metal oxide semiconductor) transistor and a low-pass filter; and a plurality of switch-load circuits, each of said plurality of switch-load circuits comprising a load, a power-on switch controlled by a logical signal, a decoupling capacitor, and a common-drain NMOS transistor, wherein a drain of the common-drain NMOS transistor connects to the regulated voltage, a gate of the common-drain NMOS transistor connects to the reference gate voltage via the power-on switch, a source of the common-drain NMOS transistor connect to the load and the decoupling capacitor, a length of the common-drain NMOS transistor is the same as a length of the diode-connect NMOS transistor, and a width of the common-drain NMOS transistor is equal to a width of the diode-connect NMOS transistor times a ratio between a current of the load and the bias current.

In an embodiment, a method comprises: incorporating a voltage regulator to output a regulated voltage in accordance with a first reference voltage; incorporating a bias voltage generator to output a reference gate voltage in accordance with a bias current, the bias voltage generator comprising a series connection of a resistor and a diode-connect NMOS (n-channel metal oxide semiconductor) transistor and a low-pass filter; incorporating a plurality of switch-load circuits, each of said plurality of switch-load circuits comprising a load, a power-on switch controlled by a logical signal, a decoupling capacitor, and a common-drain NMOS transistor, wherein a drain of the common-drain NMOS transistor connects to the regulated voltage, a gate of the common-drain NMOS transistor connects to the reference gate voltage via the power-on switch, a source of the common-drain NMOS transistor connect to the load and the decoupling capacitor, a length of the common-drain NMOS transistor is equal to a length of the diode-connect NMOS transistor, and a width of the common-drain NMOS transistor is equal to a width of the diode-connect NMOS transistor times a ratio between a current of the load and the bias current.

DETAILED DESCRIPTION OF THIS DISCLOSURE

Figure 1:
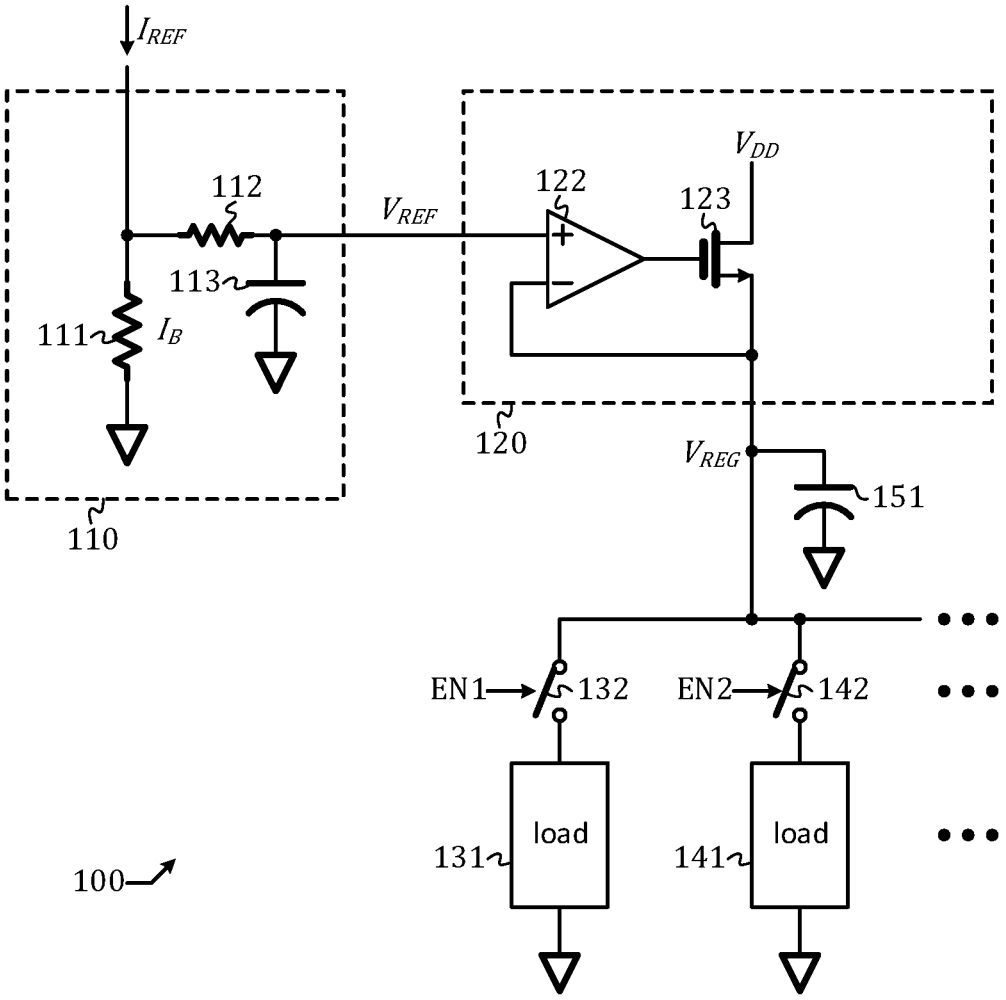
FIG. 1 (Prior Art)
FIG. 1 shows a schematic diagram of a prior art voltage regulation system.

The present disclosure is directed to voltage regulation. While the specification describes several example embodiments of the disclosure considered favorable modes of practicing the invention, it should be understood that the invention can be implemented in many ways and is not limited to the particular examples described below or to the particular manner in which any features of such examples are implemented. In other instances, well-known details are not shown or described to avoid obscuring aspects of the disclosure.

Persons of ordinary skill in the art understand terms and basic concepts related to microelectronics that are used in this disclosure, such as "voltage," "current," "power," "CMOS (complementary metal oxide semiconductor)," "NMOS (n-channel metal oxide semiconductor)," "PMOS (p-channel metal oxide semiconductor)," "resistor," "capacitor," "switch," "decoupling," "low-pass filter," "operational amplifier" and "negative feedback." Terms like these are used in a context of microelectronics, and the associated concepts are apparent to those of ordinary skills in the art and thus will not be explained in detail here.

Persons of ordinary skill in the art can recognize a capacitor symbol and a ground symbol, can recognize a MOS (metal-oxide semiconductor) transistor symbol, for both PMOS transistor and NMOS transistor, and identify the "source," the "gate," and the "drain" terminals thereof. Those of ordinary skill in the art can read schematics of a circuit comprising capacitors, NMOS transistors, and PMOS transistors, and do not need a verbose description about how one transistor connects with another in the schematics. Persons of ordinary skills in the art understand a concept of "common-drain" circuit and does not need explanations. Those of ordinary skills in the art understand units such as micron (μm), nanometer (nm), pico-Farad (fF), mega-Ohm (MOhm), micro-Amp (μA), and mini-Amp (mA). Those of ordinary skill in the art understand the Ohm's law and don't need explanations.

Throughout this disclosure, a "signal" is either a voltage or a current carrying a certain information.

This present disclosure is disclosed in an engineering sense. For instance, "X is equal to Y" means "a difference between X and Y is smaller than a specified engineering tolerance."

Throughout this disclosure, "$V_{DD}$" denotes a power supply node.

A logical signal is a voltage signal of two states: an "asserted" state and a "de-asserted" state. A switch is a device controlled by a logical signal; the switch is approximately a short circuit and is said to be turned on when the logical signal is asserted, and approximately an open circuit and is said to be turned off when the logical signal is de-asserted. A switch can be embodied by a NMOS transistor, where a logical signal controls the gate of the NMOS transistor, and the source and the drain of the NMOS transistor form two input/output terminals.

A first logical signal is said to be a logical inversion of a second logical signal, if the first logical signal and the second logical signal are always in opposite states. That is, when the first logical signal is asserted, the second logical signal is de-asserted; when the first logical signal is de-asserted, the second logical signal is asserted. When a first logical signal is said to be a logical inversion of a second logical signal, the first logical signal and the second logical signal are said to be complementary to each other.

A "diode-connect NMOS transistor" is a NMOS transistor configured in a topology wherein its gate connected to its drain.

A "decoupling capacitor" is a capacitor configured to hold a supply voltage at a node so that the supply voltage is steady and does not have a large spike when there is a sudden change in a current drawn from the node.

A "common-drain NMOS transistor" is a NMOS transistor configured in a topology wherein a voltage at its drain is substantially stationary, an input is received at its gate, and an output is output from its source.

A NMOS transistor is turned off when a gate-to-source voltage is below a threshold voltage and is turned on when the gate-to-source voltage is above the threshold voltage. An "over-drive" voltage is the gate-to-source voltage minus the threshold voltage. A current of a NMOS transistor depends on the over-drive voltage, a width, and a length of the NMOS transistor.

A circuit is a collection of a transistor, a capacitor, a resistor, a switch, and/or other electronic devices interconnected in a certain manner. A system is a collection of circuits.

A schematic diagram of a voltage regulation system 200 in accordance with an embodiment of the present disclosure comprises: a voltage regulator 220 configured to output a regulated voltage $V_R$ in accordance with a first reference voltage $V_{R1}$; a bias voltage generator 210 configured to receive a bias current $I_B$ and output a reference gate voltage $V_G$; and a plurality of switch-load circuits including a first switch-load circuit 230, a second switch-load circuit 240, and so on, configured to receive power from the regulated voltage $V_R$ and establish bias in accordance with the reference gate voltage $V_G$. The first (second) switch-load circuit 230 (240) comprises a power-on switch 231 (241) controlled by a logical signal EN1 (EN2), a common-drain NMOS (n-channel metal oxide semiconductor) transistor 232 (242), a load 233 (243), and a decoupling capacitor 235 (245). In a further embodiment, the first (second) switch-load circuit 230 (240) further comprises a power-off switch 234 (244) controlled by a complementary logical signal EB1 (EB2), which a logical inversion of EN1 (EN2).

Figure 2:
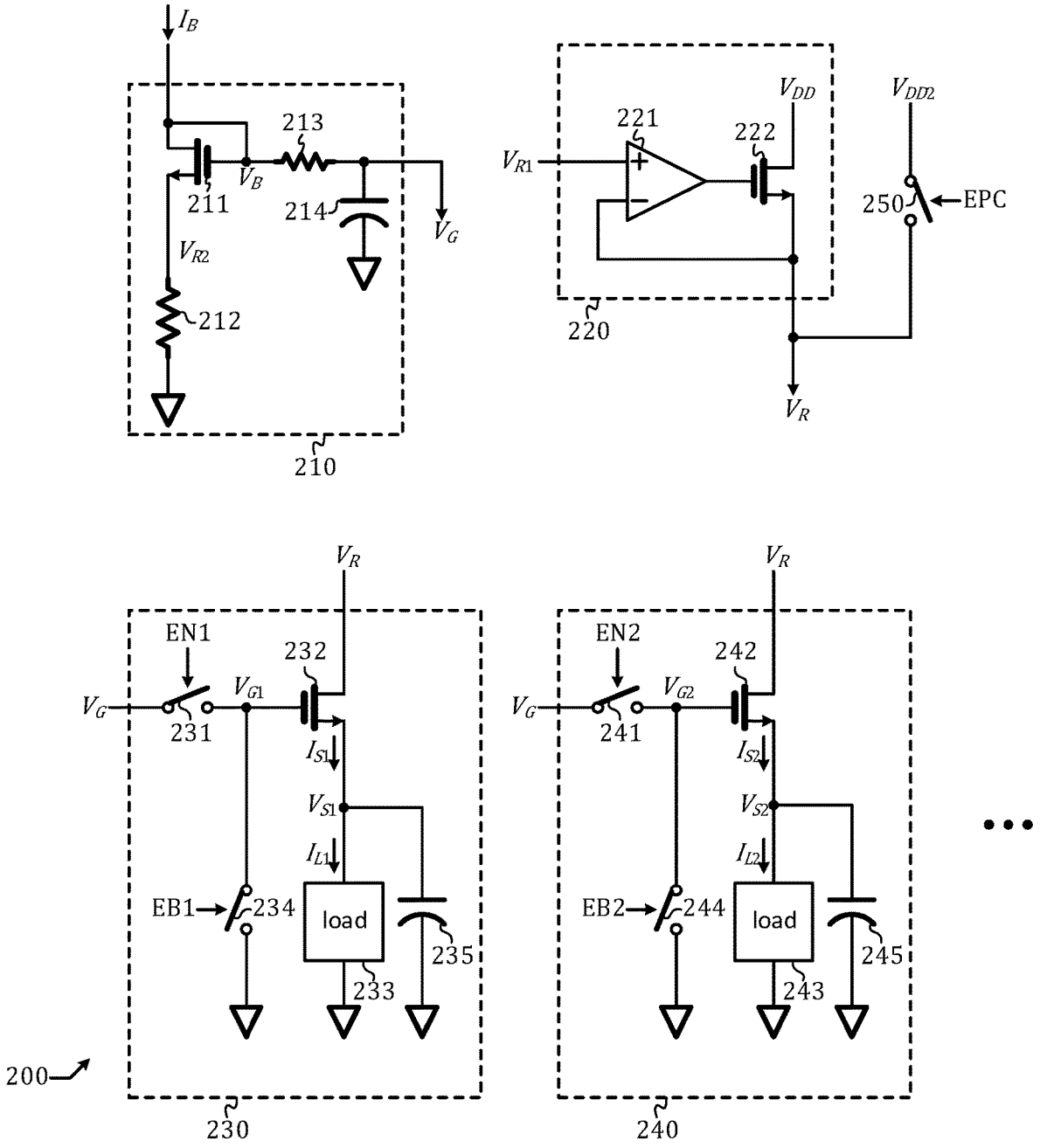
FIG. 2 shows a schematic diagram of a voltage regulation system in accordance with an embodiment of the present disclosure.

The voltage regulator 220 comprises a NMOS transistor 222 and an operational amplifier 221. NMOS transistor 222 is referred to as a power transistor, as it provides power to said plurality switch-load circuits (230, 240, and so on). The operational amplifier 221 and NMOS transistor 222 are configured to form a control loop with negative feedback to make the regulated voltage $V_R$ approximately equal to the first reference voltage $V_{R1}$. A compensation (for instance, by using a shunt capacitor, not shown in FIG. 2 but obvious to those of ordinary skill in the art, configured to shunt an output of the operational amplifier 221 to either "$V_{DD}$" or ground) may be needed to ensure stability of the control loop. The voltage regulator 220, along with the concepts of "operational amplifier," "control loop," "negative feedback," "stability," and "compensation" in a context of a control system are well known to those of ordinary skill in the art and thus not described in detail here. In an alternative embodiment, the power transistor, i.e. NMOS transistor 222, is replaced with a PMOS (p-channel metal oxide semiconductor) transistor, and the "+" and the "−" terminals of the operational amplifier 221 are swapped so that the negative feedback is preserved. This alternative embodiment, along with a need for a compensation to ensure stability, are also well known in the prior art and thus not described in detail.

The bias voltage generator 210 comprises a diode-connect NMOS transistor 211, two resistors 212 and 213, and a capacitor 214. For brevity, hereafter the diode-connect NMOS transistor 211 is simply referred to as NMOS transistor 211. The bias current $I_B$ flows to resistor 212 via NMOS transistor 211, thus establishing a second reference voltage $V_{R2}$. Applying the Ohm's law, one has:

$$V_{R2}=I_B \cdot R_{212}. \quad (1)$$

Here, $R_{212}$ denotes a resistance of resistor 212. A bias voltage $V_B$ is established at the gate of NMOS transistor 211 and can be expressed by the following equation:

$$V_B=V_{R2}+V_{TH211}+V_{OD211}. \quad (2)$$

Here, "$V_{TH211}$" is a threshold voltage of NMOS transistor 211, and $V_{OD211}$ is an over-drive voltage of NMOS transistor 211 that depends on the bias current $I_B$, a width, and a length of NMOS transistor 211. Resistor 213 and capacitor 214 form a low-pass filter, so that the reference gate voltage $V_G$ is approximately equal to the bias voltage $V_B$ but less noisy. Therefore, the reference gate voltage $V_G$ can be expressed by the following equation:

$$V_G \cong V_{R2}+V_{TH211}+V_{OD211}. \quad (3)$$

In the first switch-load circuit 230, the gate of the common-drain NMOS transistor 232 connects to the reference gate voltage $V_G$ via the power-on switch 231 and to ground via the power-off switch 234. For brevity, hereafter the common-drain NMOS transistor 232 is simply referred to as NMOS transistor 232. Here, a voltage at the gate of NMOS transistor 232 is denoted by $V_{G1}$, a voltage at the source of NMOS transistor 232 is denoted by $V_{S1}$, a source current output by NMOS transistor 232 is denoted by $I_{S1}$, and a load current sunk by load 233 is denoted by $I_{L1}$. When EN1 is de-asserted and thus EB1 is asserted, the power-on switch 231 is turned off to disconnect $V_{G1}$ from $V_G$, while the power-off switch 234 is turned on to pull $V_{G1}$ to ground; in this case, NMOS transistor 232 is shut off, causing $I_{S1}$ to be zero; consequently, $V_{S1}$ will be pulled down by the load current $I_{L1}$ and eventually drops to ground, and the load current $I_{L1}$ cannot be sustained and also has to drop to zero; as a result load 233 is powered off. When EN1 is asserted and thus EB1 is de-asserted, the power-on switch 231 is turned on to pull $V_{G1}$ to $V_G$, while the power-off switch 234 is turned off to disconnect $V_{G1}$ from ground; in this case, NMOS transistor 232 is turned on to output the source current $I_{S1}$ so that $V_{S1}$ can be sustained as the load current $I_{L1}$ is drawn by load 233. $V_{S1}$ can be expressed by the following equation:

$$V_{S1} \cong V_G-V_{TH232}-V_{OD232}=V_{R2}+V_{TH211}+V_{OD211}-V_{TH232}-V_{OD232}. \quad (4)$$

Here, "$V_{TH232}$" is a threshold voltage of NMOS transistor 232, and $V_{OD232}$ is an over-drive voltage of NMOS transistor 232 depending on the source current $I_{S1}$, a width, and a length of NMOS transistor 232. In an embodiment, NMOS transistor 232 and NMOS transistor 211 have the same length and the same threshold voltage, i.e. $V_{TH211}$ is equal to $V_{TH232}$.

In an embodiment, a width of NMOS transistor 232 is determined by $I_{L1}$ in accordance with the following equation:

$$W_{232}=W_{211} \cdot I_{L1}/I_B. \quad (5)$$

Here, $W_{232}$ is the width of NMOS transistor 232 and $W_{211}$ is a width of NMOS transistor 211. Decoupling capacitor 235 is used to make $V_{S1}$ steadier and reduce a spike when there is a sudden change in $I_{L1}$. In a steady state, $I_{S1}$ is approximately equal to $I_{L1}$. From equation (5), one has the following equation:

$$W_{232} \cong W_{211} \cdot I_{S1}/I_B. \quad (6)$$

Equation (6) suggests NMOS transistor 211 and NMOS transistor 232 have the same current density (current per width). Since they also have the same length, they must have the same over-drive voltage. That is, $V_{OD211}$ is equal to $V_{OD232}$. Therefore, equation (4) can be simplified to:

$$V_{S1} \cong V_{R2}. \quad (7)$$

This way, $V_{S1}$, a supply voltage for load 233, is approximately equal to the second reference voltage $V_{R2}$, and thus the supply voltage to load 233 is regulated.

The second switch-load circuit 240 is functionally the same as the first switch-load circuit 230, whereas power-on switch 231 is replaced with power-on switch 241, NMOS transistor 232 is replaced with NMOS transistor 242, power-off switch 234 is replaced with power-off switch 244, load 233 is replaced with load 243, decoupling capacitor 235 is replaced with decoupling capacitor 245, EN1 is replaced with EN2, EB1 is replaced with EB2, $V_{G1}$ is replaced with $V_{G2}$, $I_{S1}$ is replaced with $I_{S2}$, and $I_{L1}$ is replaced with $I_{L2}$. NMOS transistor 242 and NMOS transistor 211 have the same length, and a width of NMOS transistor 242 is determined by $I_{L2}$ in accordance with the following equation:

$$W_{242} \cong W_{211} \cdot I_{L2}/I_B. \quad (8)$$

Here, $W_{242}$ is the width of NMOS transistor 242. Following the same rationale as in the case of the first switch-load 230, one can show that $$V_{S2} \cong V_{R2}. \quad (9)$$

This way, each switch-circuit of switch-load circuits 230, 240, and so on can be powered up or powered down independently, and when it is powered up, the load thereof is supplied by a supply voltage regulated and approximately equal to the second reference voltage $V_{R2}$.

The voltage regulation system 200 has an advantage over the prior art voltage regulation system 100 in that a decoupling capacitor used to alleviate a spike of a supply voltage of a load is decoupled from the voltage regulator 220 and thus does not affect a stability of the voltage regulator 220. For instance, decoupling capacitor 235 can effectively alleviate a spike of $V_{S1}$ but is decoupled from the voltage regulator 220 because NMOS transistor 232 provides a reverse isolation. Another advantage is: the supply voltage of the load is highly insensitive to the power supply voltage $V_{DD}$, as there are two layers of isolation: one provided by the voltage regulator 220, and the other provided by the common-drain transistor.

By way of example but not limitation, in an embodiment: voltage regulator system 200 is fabricated on a silicon substrate using a 28 nm CMOS process; $V_{DD}$ is 1.35V; $V_{R1}$ is 1.2V; $I_B$ is 100 μA; $R_{212}$ is 10 KOhm; resistor 213 is 1 MOhm; capacitor 214 is 10 pF; width/length of NMOS transistor 211 is 20 μm/250 nm; $I_{L1}$ is 1 mA; width/length of NMOS transistor 232 is 200 μm/250 nm; decoupling capacitor 235 is 5 pF; $I_{L2}$ is 2 mA; width/length of NMOS transistor 232 is 400 μm/250 nm; and decoupling capacitor 245 is 10 pF.

In a further embodiment, the voltage regulation system 200 further comprises a power-cut switch 250 configured to connect the regulated voltage $V_R$ to another power supply node "$V_{DD2}$" in accordance with an additional logical signal EPC. When the additional logical signal EPC is asserted, the voltage regulation system 200 is said to be in a power-cut mode, wherein the regulated voltage $V_R$ is pulled to $V_{DD2}$ via the power-cut switch 250, and the voltage regulator 220 must be disabled to prevent a contention between the voltage regulator 220 and the power-cut switch 250. Disabling the voltage regulator 220 can be fulfilled by various ways, for instance, powering off the operational amplifier 221, or setting the first reference voltage $V_{B1}$ to zero. In this power-cut mode, the common-drain transistor (e.g. NMOS transistor 232) in each switch-load circuit (e.g. switch-load circuit 230) can still provide voltage regulation for the voltage at the load (e.g. $V_{S1}$ at load 233). Although this power-cut mode may provide less voltage regulation, there could be a benefit of power saving because the voltage regulator 220 is disabled. In other words, it allows a freedom for a trade-off between power consumption and voltage regulation. In an embodiment, $V_{DD2}$ and $V_{DD}$ are the same power supply node, i.e. they are electrically shorted.

Those skilled in the art will readily observe that numerous modifications and alterations of the device and method may be made while retaining the teachings of the disclosure. Accordingly, the above disclosure should not be construed as limited only by the metes and bounds of the appended claims.

What is claimed is:

1. A system comprising:

a voltage regulator configured to receive a first reference voltage and output a regulated voltage;

a bias voltage generator comprising a diode-connect transistor and a resistor connected in series configured to receive a bias current and output a reference gate voltage; and a plurality of switch-load circuits, each of said plurality of switch-load circuits comprising a common-drain transistor configured to receive power from the regulated voltage, receive control from the reference gate voltage via a switch controlled by a logical signal, and output a supply voltage to a load shunt with a decoupling capacitor, wherein a size of the common-drain transistor is scaled from a size of the diode-connect transistor in accordance with a ratio between a current of the load and the bias current, wherein:

the diode-connect transistor and the resistor connected in series establish a bias voltage equal to a threshold voltage of the diode-connect transistor plus an over-drive voltage of the diode-connect transistor plus a product of the bias current and a resistance of the resistor, the bias voltage reference generator further comprising a low-pass filter configured to filter the bias voltage into the reference gate voltage, and a length of the common-drain transistor is equal to a length of the diode-connect transistor, a width of the common-drain transistor is equal to a width of the diode-connect transistor times the ratio between the current of the load and the bias current.

2. The system of claim 1, wherein the voltage regulator comprises a power transistor and an operational amplifier configured to form a control loop with negative feedback to make the regulated voltage approximately equal to the reference voltage.

3. The system of claim 1, wherein the switch-load circuit further comprises an additional switch controlled by a complementary logical signal configured to pull a gate of the common-drain transistor to ground when the complementary logical signal is asserted.

4. A system comprising:

a voltage regulator configured to receive a first reference voltage and output a regulated voltage;

a bias voltage generator configured to receive a bias current and output a reference gate voltage, the bias voltage generator comprising a series connection of a resistor and a diode-connect NMOS (n-channel metal oxide semiconductor) transistor and a low-pass filter; and a plurality of switch-load circuits, each of said plurality of switch-load circuits comprising a load, a power-on switch controlled by a logical signal, a decoupling capacitor, and a common-drain NMOS transistor, wherein a drain of the common-drain NMOS transistor connects to the regulated voltage, a gate of the common-drain NMOS transistor connects to the reference gate voltage via the power-on switch, a source of the common-drain NMOS transistor connect to the load and the decoupling capacitor, a length of the common-drain NMOS transistor is equal to a length of the diode-connect NMOS transistor, and a width of the common-drain NMOS transistor is equal to a width of the diode-connect NMOS transistor times a ratio between a current of the load and the bias current.

5. The system of claim 4, wherein the voltage regulator comprises a power transistor and an operational amplifier configured to form a control loop with negative feedback to make the regulated voltage approximately equal to the reference voltage.

6. The system of claim 4, wherein the series connection of the resistor and the diode-establishes a bias voltage equal to a threshold voltage of the diode-connect transistor plus an over-drive voltage of the diode-connect transistor plus a product of the bias current and a resistance of the resistor.

7. The system of claim 4, wherein the low-pass filter is configured to filter the bias voltage into the reference gate voltage.

8. The system of claim 4, wherein the switch-load circuit further comprises an additional switch controlled by a complementary logical signal configured to pull the gate of the common-drain NMOS transistor to ground when the complementary logical signal is asserted.

9. A method comprising:

incorporating a voltage regulator to output a regulated voltage in accordance with a first reference voltage;

incorporating a bias voltage generator to output a reference gate voltage in accordance with a bias current, the bias voltage generator comprising a series connection of a resistor and a diode-connect NMOS (n-channel metal oxide semiconductor) transistor and a low-pass filter;

incorporating a plurality of switch-load circuits, each of said plurality of switch-load circuits comprising a load, a power-on switch controlled by a logical signal, a decoupling capacitor, and a common-drain NMOS transistor, wherein a drain of the common-drain NMOS transistor connects to the regulated voltage, a gate of the common-drain NMOS transistor connects to the reference gate voltage via the power-on switch, a source of the common-drain NMOS transistor connect to the load and the decoupling capacitor, a length of the common-drain NMOS transistor is equal to a length of the diode-connect NMOS transistor, and a width of the common-drain NMOS transistor is equal to a width of the diode-connect NMOS transistor times a ratio between a current of the load and the bias current.

10. The method of claim 9, wherein the voltage regulator comprises a power transistor and an operational amplifier configured to form a control loop with negative feedback to make the regulated voltage approximately equal to the reference voltage.

11. The method of claim 9, wherein the series connection of the resistor and the diode-establishes a bias voltage equal to a threshold voltage of the diode-connect transistor plus an over-drive voltage of the diode-connect transistor plus a product of the bias current and a resistance of the resistor.

12. The method of claim 9, wherein the low-pass filter is configured to filter the bias voltage into the reference gate voltage.

13. The method of claim 9, wherein the switch-load circuit further comprises an additional switch controlled by a complementary logical signal configured to pull the gate of the common-drain NMOS transistor to ground when the complementary logical signal is asserted.

* * * * *